US009434398B2

(12) United States Patent
Lucisano

(10) Patent No.: US 9,434,398 B2
(45) Date of Patent: Sep. 6, 2016

(54) RAIL TRANSPORT SYSTEM WITH CONVOYS AUTOMATIC COMPOSITION

(71) Applicant: CO.EL.DA. SOFTWARE SRL, Reggio Calabria (IT)

(72) Inventor: Antonio Lucisano, Reggio Calabria (IT)

(73) Assignee: CO.EL.DA. SOFTWARE SRL, Reggio Calabria (IT)

( * ) Notice: Subject to any disclaimer, the term of this patent is extended or adjusted under 35 U.S.C. 154(b) by 57 days.

(21) Appl. No.: 14/409,742

(22) PCT Filed: Jul. 1, 2013

(86) PCT No.: PCT/IB2013/055377
§ 371 (c)(1),
(2) Date: Dec. 19, 2014

(87) PCT Pub. No.: WO2014/002077
PCT Pub. Date: Jan. 3, 2014

(65) Prior Publication Data

US 2015/0191186 A1 Jul. 9, 2015

(30) Foreign Application Priority Data

Jun. 30, 2012 (IT) ..... RC2012A0009
Jun. 27, 2013 (IT) ..... CS2013A0018

(51) Int. Cl.
*B61L 27/04* (2006.01)
*B61L 27/00* (2006.01)
*B61D 3/16* (2006.01)
*B61L 17/00* (2006.01)

(52) U.S. Cl.
CPC ..... *B61L 27/04* (2013.01); *B61D 3/16* (2013.01); *B61L 27/0027* (2013.01); *B61L 27/0077* (2013.01); *B61L 17/00* (2013.01); *B61L 27/0011* (2013.01)

(58) Field of Classification Search
CPC .. B61L 27/04; B61L 27/0027; B61L 27/077; B61L 27/011; B61L 17/00; B61D 3/16
See application file for complete search history.

(56) References Cited

U.S. PATENT DOCUMENTS 5,828,979 A 10/1998 Polivka et al.
2004/0068361 A1* 4/2004 Cross ..... B61L 27/0077 701/117
2010/0114404 A1* 5/2010 Donnelly ..... B61D 3/16 701/2

* cited by examiner

*Primary Examiner* — Aaron L Troost
(74) *Attorney, Agent, or Firm* — Seed IP Law Group PLLC

(57) ABSTRACT

A rail transport system automates control of the wagon composition of a convoy of wagons by employing an existing network infrastructure. The system includes a central provider system that collects information regarding transport needs of users and controls overall operation of the system; a first peripheral system fixed in every station of the rail network and is configured to interact with the central provider system to compose the wagons of the convoy and exchange information with the wagons in the station to coordinate their movements in the station; a mobile second peripheral system located on each of the wagons and configured to coordinate the movements of the wagon; and a mobile third peripheral system on the locomotive of the convoy and configured to interact with the central provider system and the first peripheral system to define the convoy composition and coupling/uncoupling of selected ones of the wagons along a route.

9 Claims, 1 Drawing Sheet

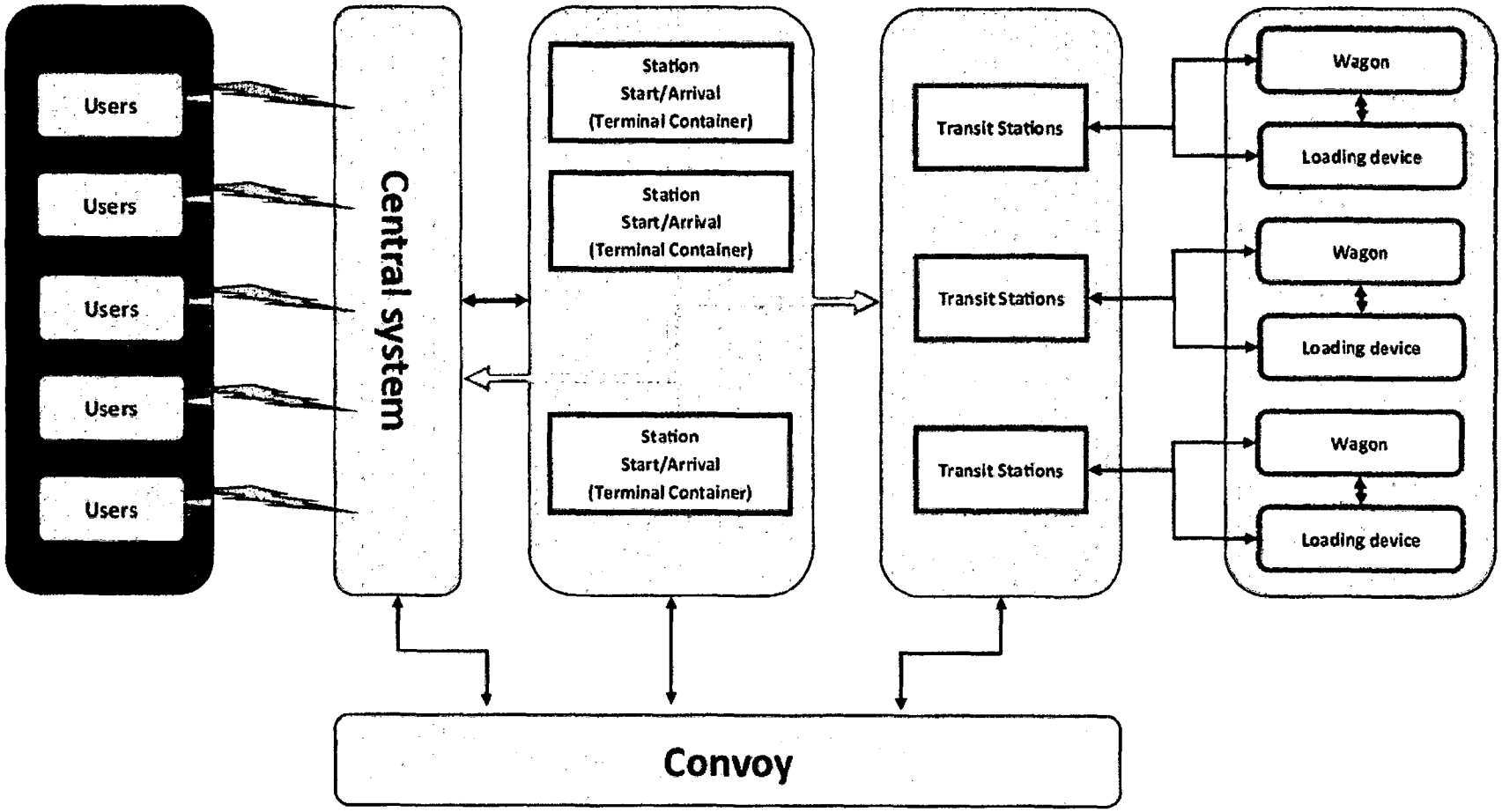
Wagon
Loading device
Wagon
Loading device
Wagon
Loading device
Transit Stations
Transit Stations
Transit Stations
Station
Start/Arrival
(Terminal Container)
Station
Start/Arrival
(Terminal Container)
Station
Start/Arrival
(Terminal Container)
Central system
Convoy
Users
Users
Users
Users
Users

RAIL TRANSPORT SYSTEM WITH CONVOYS AUTOMATIC COMPOSITION

BACKGROUND

1. Technical Field

The present invention relates to a rail transport system with automatic composition of convoys.

2. Description of the Related Art

As is well known, the management of the movement of wagons, mainly in the transport of goods, is currently managed on the basis of planning the offer of transport, conceived at table on the basis of historical data and presumable trends in affairs, without taking into account the effective present request. In fact, the availability of a train for the transfer of a goods wagon, collecting it from any particular station along the routes covered by the trains, is costly and very slow.

Actually, there is no central coordination between the needs for transport and the same offer of transport is often undersized because, in the absence of certain or probable requests for transport, the creation of costly logistics structures is avoided. Hence, in the majority of cases, the trains are formed in the station of departure and arrive unformed at the station of arrival, where only later they will be shunted. Nevertheless, this operation doesn't take account of optimization of the routes of the single wagons, so creating evident diseconomies if, in a station of departure, there is insufficient demand for transport. Moreover, the stations of movements necessitate the presence of a specific office (with the relative organization of spaces, equipment, people, movement of information) that manages the incoming and departing movements. In particular, technical personnel assigned to coupling/uncoupling the wagons must be present, other than the administrative staff. In addition, it should be requested a shunting locomotive (otherwise it is necessary to use the train's locomotive) and the relative train-driver. This costly organization existed some years ago, but it has been suppressed, firstly by suppressing the presence of the goods bays in the smaller stations, then by closing the offices, even in some of the main stations, up to the current scant numbers. The lack of demand closes goods yards, the absence of which in turn inhibits the birth of any demand for goods transport by rail.

Known solutions have been proposed to solve this problems.

As an example, the patent application WO2010043967A1 published on Apr. 22, 2010 in the name of DONNELLY FRANK WEGNER describes a rail-based system for moving materials, in particular a system of automated self-powered rail cars operating independently to transport material such as one from a work face in a mine or cargo from a marine port to a major transportation hub. In a specific embodiment, in the railway transport system a railway network, controlled by a central control unit, foresees the use of an intelligent carriage, equipped with an autonomous computerized control unit which coordinates the movements of the carriage, following the indications that arrive from the central system and at least from one element of controllable rail-track. The system operates in the following way: the central unit knows the geographical (spatial) position of each of the railway carriages because of the reception of signals of position from every carriage. Every carriage has a single identity code and periodically transmits the information perceived and gathered to the central unit. The control interface receives information from each signal emitter for the successive section of rail in the direction of travel. As a railway carriage comes closer to an element of rail, the physical and spatial position of the carriage is determined by the central unit and suitable commands are sent to the section of rail. For example, the formulation of a switch is modified to direct the carriages to the second or third section of rail. In response to various stimuli, such as the weather or the traffic conditions, the central unit is capable of sending different groups of signals or instructions to the signal emitters to pass to the carriage. The main function is that of hauling. The wagon can be compared to a small locomotive, with the possibility of it being controlled from a distance. The single wagons with the total number of engines mounted on the axles determine the maximum autonomous or supporting motive-power to move the train, which remains, however, within the classical ideology of movement and management of railway traffic.

So, it is evident that this patent application foresees the possibility of an autonomous movement of the wagon in a context of traditional trains, which integrates in a natural way since the wagon can couple itself to all the existing wagons.

The problem of this solution is that the control of single rail track elements and of their composition into the existing railway lines is made with necessary modifications of the existing rail network infrastructure. Moreover, it is foreseen that the operations of uncoupling the wagons take place with the classic techniques that necessitate specific personnel for the operations of uncoupling and coupling. In addition, on board a locomotive there isn't a system of control of the carriages and interface with the network owner and therefore with switching management systems. For these reasons, such a solution would be difficult to introduce into an international railway network in which the various international networks are connected between themselves. In fact, every national railway network has its own control system, and the introduction of sections controlled by a central system would encounter the difficulty of utilizing a single system of control of the sections of rail.

A second solution is described in the U.S. Pat. No. 5,828,979 assigned on Oct. 27, 1998 to HARRIS CORP. The solution consists in a system and method for controlling the movement of plural freight trains through a multiple route railway system with improved efficiency and safety. Freight train movements are precisely monitored and orchestrated in accordance with a dynamic schedule that is determined through an evaluation of delivery requirements, coordination among all trains, speed restrictions and the effects of the track topography and train consist on train response to brake and power application.

Even if advantageous under many aspects, this system only permits the implementation of a program but doesn't intervene in the effective composition of the train. It is limited to managing a train that is already formed or is to be formed, but the formation of the train remains traditional and foresees the participation of manual shunters, leaving the costs of railway transport on the goods unchanged. Furthermore, it is applicable only to the transport of goods.

BRIEF SUMMARY

Purpose of the present invention is to provide a rail transport system with automatic composition of convoys which doesn't carry out any structural works and therefore without interfering with the existing rail traffic.

According to the present invention, a rail transport system with automatic composition convoys is realized, as defined in claim 1.

BRIEF DESCRIPTION OF THE DRAWINGS

For a better understanding of the present invention a preferred embodiment is now described, purely as a non-limiting example, with reference to the accompanying drawings, in which:

FIG. 1 shows a schematic view of a rail transport system with convoys automatic composition, according to the invention.

DETAILED DESCRIPTION

With reference to these figures, and, in particular, to FIG. 1, a rail transport system with convoys automatic composition is shown, according to the invention. In details, the rail transport system with automatic composition of convoys comprises elements that determines the departure of a wagon determining it by the demand that is carried out by the various operators connected by the Web from a specific portal, and by the physical availability of the wagon itself.

The wagons involved in departure are formed in a new train that connects two terminal stations, and the departure itself will be determined in two different ways:

Programmed departures at fixed times and on fixed days.

Departures deriving from the presence in the stations (of departure and transit) of a number of wagons in waiting, such as to necessitate the formation of a new train.

The authorization for the departure of the train and the occupation of the line in a determined section, can be managed with the maximum elasticity. There will be, therefore, no timetable limitations to respect, subordinating the distance covered from the section of departure (and so forth for all the successive sections until the station of arrival) to its effective availability, creating in an opportunistic way the maximum possible speed for the train and also optimizing the use of the sections, which it will occupy only when these same are not occupied by other trains, with lower costs.

The progress of the train, with the necessary stops, will be totally automatic. It will receive orders and authorizations from the "owner of the railway network", proceeding from section to section based on the needs and availability of the network.

It will pass on to the "owner of the railway network" its need to stop at the single intermediate stations interested in operations of coupling/uncoupling of the wagons of the train.

On board the train there will be only a train driver, who will manage the train in the conventional manner and have functions of control for the safety and management of breakdowns or eventual unforeseen events.

The integrated hardware structure of the entire system is composed of the following elements. It is constituted by a central system and three peripheral ones:

The central system is constituted by "servers" that host all the information management programs. Its function is to collect the users' needs for transport; plan and coordinate all the transport needs and the management of the trains; interact, both with authorized users in control and in management, and with the peripheral systems.

A first peripheral system will be fixed in every station in which the single wagons can be parked. Its function is to exchange information with the wagons present in stations to survey their state and coordinate movements in the station, interacting with the owner of the railway network; Interact with the central system to provide information about transport needs (dispatch/storage) present in the station.

A second peripheral system will be mobile, and situated on each single wagon. Its function is to coordinate the movements of the wagon, following the indications coming from the station system, also taking into account the signals from the sensors on board. Furthermore, communicate its state for transport and loading/unloading needs.

A third peripheral system will be mobile, and situated on the locomotive of the train. The function is to interact with the central system to define journey needs (train composition, coupling/uncoupling wagons in stations along the route) and to interact with the station's fixed system.

Diverse configurations for the management of information (for example a centralized management that incorporates the functions of the stations' systems) can be implemented without constituting innovations to the present invention.

A "smart" wagon is realized modifying a traditional wagons (both of the flatcar type suitable for the transport of containers, and of every other kind including passenger carriages) to make them autonomous in the phases of manoeuvre and coupling to the wagons, carrying out orders that are transmitted from the informatics platform. Starting from the basic structure of a traditional wagon, a smart wagon will be created, provided with electric engines for movement with an autonomous power supply (batteries or another energy accumulating device), a device for coupling/uncoupling between wagons with automatic and sensorial control systems, an automatic system of connection between wagons, both for the braking element (which must also function autonomously) and for the electrical part, an external control system for the safety of autonomous movements and for positioning on the lines.

The wagons will be furnished with a hardware platform, complete with a microprocessor which will be the "brain" of the wagon, said processor will manage the whole wagon and all the systems described in following. The wagon's safety systems (proximity sensors, radar, thermal sensors, braking system) can be provided with a second microprocessor which will start to function only in the case of sensing danger and the lack of a reply from the central processor, thus a further superabundance of the safety systems will be guaranteed.

The engines present on the wagon, that act directly on the wheels, can also be used other than for the initial starting acceleration of the train, but in other situations of necessity for the speed of the train, such as when travelling over a section with a gradient, necessitating additional pulling power to that expressed by the locomotive, or to permit the creation of much longer trains, lightening, with the pressure of pull exercised by the engines, the tension on the connecting joints between wagons.

A small compressor, fed by the wagon's batteries will allow action on the braking system.

The coupling system for the train will consist of a mechanical device that permits the coupling between wagons with only the power of thrust. The coupling will provoke the mutual insertion of two coupling pins between the two wagons. The same coupling pins, to permit the uncoupling of the wagon, will be automatically extracted by an electronic device controlled by the "brain" of the wagon. The complete structure of the coupling system is composed of two structures, a fixed central block into which the systems of mechanical blockage and connection between the wagons will be inserted. In this block the compressed air tubes, the electrical connection between the wagons (necessary for their feed) will be included. These "fixed joints" will be connected to the wagon by the mobile joints, guaranteeing the necessary elasticity of movement to the wagons, which will be free to move both horizontally (wagons in a curve) and vertically (movements of the suspension). Different, or other alternative automatic mechanisms of coupling/uncoupling will have the same conceptual managing mechanism. The simultaneous presence of two coupling pins (controlled autonomously by each wagon) will increase safety to avoid an undesired uncoupling.

The coupling of the wagon to the train will permit the re-charging of the batteries that feed the engines for the autonomous movement of the wagon and the remaining electrical and electronic equipment. The re-charging of the batteries can also be ensured, during the journey, by the presence of on-board energy recuperating devices, recovering energy during braking, from re-charging points present in the single stations, for example on the terminal buffers of service tracks, when parked in waiting for a journey.

Once the coupling to the train has taken place the locomotive will have absolute priority of control over the single smart wagons, these will be controlled by the system present on board the locomotive and will not be able to carry out autonomous operations if not imparted by this system except in "special" cases. That is, there will be present on the train a generalized control of the couplings with verification of connection before the train is put into movement, permitting its unblocking, to allow the automatic movement of the wagons, when the train is stopped in a station or in proximity of the same for operations of consignment. The automatic blockage will always activate automatically, when the wagons are in movement coupled to the train during normal travel.

Being smart wagons and provided with their own "brain", an automatic management of arrest and flight in exceptional situations will be possible (for example, railway accidents). Other possible cases in which the wagon could decide to operate autonomously, or as a partial train (a number of united wagons), can be situations of accidental disconnection of another wagon, emergency communications from the locomotive, or other cases of danger pre-determined by the programming of the wagon and variables (for example, according to the type of load which is transported—normal goods or dangerous goods), the smart wagons can, in such situations, carry out an emergency disconnection and brake automatically. Furthermore, in the case of the presence of dangerous goods (chemicals, gas, etc.) they can automatically move themselves away from the area of the accident, avoiding a worsening of the conditions of danger, caused for example by a fire, and quickly remove the wagon to a safer place.

Before uncoupling the wagon, the braking system devices and the electrical system will be disconnected.

The communications system between wagons/station/locomotive will take place by means of a radio wave system on a network of connections present in the stations (when stopped in them) or by "direct" connections on the train (when connected to the other wagons). The method of transmission will not be entrusted simply to a system of transmitter-receiver but, to guarantee an abundant and reliable connection, other than receiving and transmitting its own information, every radio structure (wagon-station-locomotive) will also have the role of network repeater.

In order to manage the conceived system notwithstanding the "network owner", the interfacing will be managed through the definition of standard controls and communications between the software components of the two systems. These will therefore always remain distinct and autonomous. To integrate into the current systems, without needing modifications to the current models of functioning of traffic management, only standard systems of communication will be necessary. The elements present in the station system will interface with the different "network owners" through specific modules (such as the drivers of the computers' devices), while they will have an identical management for as much as concerns the new system created, wherever the wagons/trains may be.

The wagon will be furnished with a "brain" that will coordinate the movements of the same, interacting with the telematic platform, receiving signals from control devices, both for its position and for its movement, as well as for sensing obstacles.

To permit safe movement, the wagon will be furnished with a television camera for external and sensorial control to sense obstacles. Long and short range radar will also serve for such an end. Peripheral thermal sensors will sense the near presence of people in situations dangerous to movement.

The wagon will also have sensors pre-disposed for the automatic loading and unloading of the containers.

The wagons will be furnished with a manual external panel of controls of speed and coupling/uncoupling, that will bypass the automatic control and can be adopted only in situations of default of the system of automatic control of the wagon, both for the manoeuvres in a station and for the transfer onto parking tracks, and for the destination to a particular point of delivery where the control of the network of the tracks does not permit autonomous movement.

The present invention also relates to a method of composition and movement of the train. Commencing from the station of departure, the train will be formed on specific tracks where all the wagons involved in the departure will be arranged, coordinated in it by the Informatics Platform. For an optimal management of the journey, the sequence in which the wagons are attached to the train becomes important. To obtain greater efficiency, the order of the wagons in the train must keep present the destinations of the wagons lined up. The wagons at the head of the train are the last as to stations of destination.

This sequence will be maintained automatically, even during all the operations of coupling/uncoupling of the wagons that take place during the train's journey.

In the stations of transit the wagons in waiting will be kept in order commencing from the initial moment of their being parked. Should there already be a wagon to be coupled in the station, the new wagon will be placed at the head or tail, with respect to the direction of travel, according to whether the station of destination will be before or after that of the wagon already in waiting. In the case where more wagons with different destinations are present, it will be necessary to interface with the station's system in order to carry out the necessary manoeuvres to place it in the correct position.

This method of composing the trains is not limiting, and a different evaluation could be made in situations necessitating diverse compositions, for example in the case where the wagons must be coupled to different trains that transit from the station in different successions. This eventuality certainly takes place in stations that are junctions of numerous lines, when the trains must continue over different lines.

In the terminal stations (of departure/arrival) there will be a stock of empty wagons that will be coupled in variable numbers to the train departing, in substitution of the wagons for which the demand for a journey, increased by a number held to be congruous for extemporary reasons (requests for journeys coming to the system after the departure of the train but before the station of transit that in the meantime requests the passage).

In the intermediate stations, with the opportune manoeuvres, always coordinated by the central system, the wagons waiting to be transferred will be coupled, and the wagons which have the station as their point of destination uncoupled. They can be both wagons that transport the containers to be consigned and empty wagons requested by the users and which will be loaded later, ready for dispatch for a new train, as well as other types of wagons and carriages, also passenger ones.

The management of the wagons to be left parked (in service) will depend, other than on statistic planning, also on the extemporary requests coming from the market's demands. The peculiarities of the system permit the carrying out of non-conventional manoeuvres such as the shunting of the wagons "in movement".

During the movement of the train, nearing the station of destination of a wagon (but the manoeuvre is identical for other contiguous wagons that will necessarily be at the tail of the train precisely because of the given order) the cutting out of the wagon will be ordered, without halting the train.

If, in the same station, it is not necessary to couple wagons waiting to travel, the train will be able to proceed its journey over the main line, without making a stop.

Before the uncoupled wagon reaches the switching point of the service track (which is always present in every station), this will be activated to permit the "parking" of the wagon on this track and then successively have it placed in a specific area that does not create any obstacles to the normal running of traffic, which could be one of the final bays of this track.

If it necessary to couple wagons to the train in transit, these can already be present on the service track in the same order foreseen for the train. During its passage through the station the train will separate at the point where the wagon in waiting must be inserted, and the head of the train will continue ahead slowly, passing the point where the switching point is situated where the wagon to be coupled is parked, and which at this point will begin to move at the same time as the activation of the switch which permits its entry onto the track of movement and will proceed to couple itself to the head of the train.

At this point the switch will re-position itself to allow the passage of the tail of the train, which will also couple itself and re-constitute the entire train as a whole, which can continue the journey without having effected any stops.

This operation of separating the train in the station can be carried out at various successive points of the train, depending upon the presence of n-wagons parked with different, noncontiguous destinations, and the operations on the switching point on the main tracks and the coupling of the wagon in waiting to the head of the train will be automatically repeated n-times.

The optimal points of the railway line to carry out the separation of the wagons, the velocity at which the train must travel in the station, the velocity with which the wagons waiting to be coupled proceed and, in the case of insertion into the central parts of the train, also of the tail of the train previously separated itself, and all the other elements of the management of the journey, depend on many factors, among which the characteristics of the switches (greater or lesser velocity of switching), the velocity of interfacing with the network's owner, the characteristics of the speed of the wagon, etc.

Another possibility offered by the intrinsic characteristics of the wagon, is the opportunistic possibility of requesting "lifts" from any train in transit, such as local passenger trains that can be used for short movements and which can optimize the management of withdrawals and deliveries, for example having the function of trains of collection, and the concentration on particular stations and deliveries that leave from these same.

The characteristics of the wagon can be applied not only to freight wagons of any type, but also to passenger carriages, particularly efficient when a dynamic composition of the carriages is necessary, such as may be the needs of local transport, in which single carnages can be added/removed at intermediate stations, according to the needs for capacity of the trains. Subjects for specific further research are:

The optimization of the composition of the train, in order to reduce to the minimum the stationary times for coupling/uncoupling the wagons in the intermediate stations.

The optimization of the routes of the train, not only according to the necessities of withdrawal/delivery, but also of the operative conditions of the lines, interacting with the owner of the railway network.—The economical optimization for the decision to form and start a new train on the basis of the demands from the users and the availability of the structures (equipment and lines).

Concerning the method of loading/unloading container-carrying wagons, the modality of movement of the containers will depend on the dimensions of the station of transit.

For big stations (or those with a high volume of movements), the loading/unloading of the containers will take place in automatic mode, without the need for specific operators.

The equipment necessary will be constituted by a mobile wagon on wheels (or of the type with tyres used in ports for the movement of containers within the port area but opportunely provided with sensors), with a fixed motorized device placed on the upper part (with a two-dimensioned mobile plane device for the correct automatic gripping of the containers) to raise/lower the containers, and of another, sensorial, to send signals of positioning to the railway wagons.

It will be necessary for the automatic loading/unloading of the containers (empty/full) of the wagon and its stocking in pre-ordained positions along a pre-arranged section. The height of the stock in a pile will depend on the height of the wagon. It will also automatically carry out the loading/unloading of other means of tyre-fitted transport, which will position itself for this operation. The correct centering of the points of gripping will be done automatically by the mobile part of the device.

For smaller stations the movements can be carried out with a fork-lift truck made available, whose use for the movements can also be delegated to the users consignees of the container, who will certainly have available the human resources assigned to similar operations in their establishments.

If a railway branch line to the place of destination is present, the same railway wagon can be delivered/withdrawn manually or automatically.

An alternative management to the current one can be put into practice at the ports that move containers. Instead of leaving the containers in transit towards destinations that foresee their transfer onto trains for their final destination on the dock, they can immediately be loaded by the cranes onto the railway wagons in waiting next to the cranes, and which will automatically position themselves in pre-defined positions with respect to these, guided by specific sensors and control systems, moving themselves as soon as the loading operation is terminated to leave a place for the next wagon to be loaded. The wagons loaded are immediately available for the successive automatic operations of attachment to trains in formation at the stations near to the port.

Therefore, the rail transport system with convoys automatic composition according to the invention is that it can be put into the existing railway networks without necessarily carrying out any structural works and therefore without interfering with the existing rail traffic. It needs only the creation of the "smart" freight wagon and the platform with the system of communication between the various control and management systems present at a central level, onboard the train, on the wagons and in the stations.

Another advantage of the rail transport system with convoys automatic composition according to the invention is that it doesn't require human intervention on site.

Another advantage of the rail transport system with convoys automatic composition according to the invention is that the demand for transport occurs in a manner that is flexible between different stations that are not necessarily those of arrival or departure of the train and the way of conceiving transport is inverted, not tied to the supplier who places a train at disposal, but to the client who, with his demand, determines the formation of a train. The method of managing the railway lines is also inverted, and their use is no longer planned on the basis of trains whose movements are determined long beforehand with fixed times of departure, of distances covered and times of arrival, but the use is "on demand" with travel plans that can be re-modulated in real time on the basis of the travel needs and the availability/saturation of lines.

Another advantage of the rail transport system with convoys automatic composition according to the invention is that the system devised also has low running costs and extreme flexibility and does not need major infrastructure and places itself in a natural manner into the existing systems without creating problems for the current method of traffic and the use of the network.

Moreover, with the rail transport system with convoys automatic composition according to the invention it is possible to obtain a high level of automation allowing the interventions of specific personnel not to be necessary at the individual stations, reducing the costs of managing the service.

Another advantage of the rail transport system with convoys automatic composition according to the invention is that the infrastructure for the automation of the process of loading/unloading of containers can be created only if held to be economically convenient with the increase in demand at specific transit stations.

Finally it is clear that the rail transport system with convoys automatic composition according to the invention described and illustrated here can be modified and varied without departing from the protective scope of the present invention, as defined in the appended claims.

The invention claimed is:

1. A rail transport system with automatic composition of wagons of a convoy travelling in the rail network infrastructure, based on demand of users, comprising:

a plurality of wagons, each wagon including an autonomous power supply, an electric engine for movement of the wagon, a device for coupling/uncoupling between wagons with automatic and sensorial control system, with an automatic system of coupling/uncoupling with other wagons and with a locomotive of the convoy;

a central provider system constituted by servers that host all management programs that collect information regarding transport needs of the users via web and are configured to interface with the users of the rail network infrastructure;

a first peripheral system, fixed in every station of the rail network infrastructure in which at least one of the wagons is parked, the first peripheral system being configured to receive the information about the users' transport needs from the central provider system in order to compose the wagons of the convoy and for exchanging information with the wagons in the station to coordinate their movements in the station;

a mobile second peripheral system located on each of the wagons and configured to coordinate the movements of the wagon, following indications coming from the central provider system and taking into account information from the sensorial control system of the wagon;

a mobile third peripheral system, situated on the locomotive of the convoy, configured to interact with the central provider system and with the first peripheral system to define a composition of the convoy and coupling/uncoupling of selected ones of the wagons along a route;

the second peripheral system being configured to execute the movements of the wagon based on indications of the third peripheral system and communicating a status of the wagon to the first peripheral system for transport and loading/unloading needs;

the central provider system and the first, second, and third peripheral systems being integrated on the rail network infrastructure in a way that the coupling/uncoupling of the wagons is determined based on requests of the users via the central provider system and controlled by the first peripheral system or by the third peripheral system so that an order of the wagons to be composed in the convoy is automatically kept during all the convoy movements.

2. The rail transport system according to claim 1, wherein:

the first peripheral system of a transit station of the stations of the rail network infrastructure is configured provide a waiting order for first and second waiting wagons at the transit station that depends on desired destination stations for the first and second waiting wagons respectively, the second waiting wagon is configured to be placed ahead or behind the first waiting wagon depending on whether the destination station of the second waiting wagon is before or after the destination station of the first waiting wagon;

the waiting wagons are configured to be coupled to the convoy and any wagons of the convoy having the transit station as their point of destination are configured to be uncoupled;

in terminal stations empty wagons are configured to be coupled to the convoy in a variable number, to satisfy existing demands for empty wagons from one or more intermediate stations, increased by a number held to be congruous to satisfy demands coming after the departure of the convoy.

3. The rail transport system according to claim 1, wherein, during passage of the convoy through one of the stations, the peripheral systems are configured to shunt a waiting wagon in movement, by separating the convoy at a point in the convoy where the waiting wagon is desired to be inserted, allowing a head of the convoy to continue ahead slowly, passing a switching point at which the waiting wagon is parked, the waiting wagon being configured to move onto a track on which the convoy is moving and to proceed to couple itself to the head of the convoy.

4. The rail transport system according to claim 1, wherein the third peripheral system situated on the locomotive of the convoy interacts with the central provider system to communicate a state of the convoy and interacts, furthermore, with the central provider system to define journey needs, convoy composition, coupling/uncoupling wagons in stations along the route, and to coordinate with a manager of the railway network infrastructure.

5. The rail transport system according to claim 1, wherein interactions for interfacing with an owner of the railway network infrastructure are made with independent methodologies and communication protocols.

6. The rail transport system according to claim 1, wherein in stations with large container traffic, loading/unloading containers from/on convoy is automated.

7. A method for rail transport with automatic composition of wagons of a convoy travelling in the rail network infrastructure, based on demand from users comprising:

providing a plurality of wagons, each wagon including an autonomous power supply, an electric engine for movement of the wagon, a device for coupling/uncoupling between wagons with automatic and sensorial control system, with an automatic system of coupling/uncoupling with other wagons and with a locomotive of the convoy;

providing a central provider system constituted by servers that host all management programs that collect information regard transport needs of the users via web and are configured to interface with the users of the rail network infrastructure;

providing a first peripheral system, fixed in every station of the rail network infrastructure in which at least one of the wagons is parked, the first peripheral system being configured to receive the information about the users' transport needs from the central provider system in order to compose the wagons of the convoy and for exchanging information with the wagons in the station to coordinate their movements in the station;

providing a mobile second peripheral system located on each of the wagons and configured to coordinate the movements of the wagon, following indications coming from the central provider system and taking into account information from the sensorial control system of the wagon, providing a mobile third peripheral system, situated on the locomotive of the convoy, configured to interact with the central provider system and with the first peripheral system to define a composition of the convoy and coupling/uncoupling of the wagons;

the second peripheral system being configured to execute the movements of the wagon based on indications of the third peripheral system and communicating a status of the wagon to the first peripheral system for transport and loading/unloading needs;

integrating the central provider system, the first peripheral system, the second peripheral system and the third peripheral system on the rail network infrastructure;

sending a request of the user via the central provider system to the first and third peripheral system exchanging information with the second peripheral system; and determining and controlling the coupling/uncoupling of the wagons so that an order of the wagons to be composed in the convoy is automatically kept during all the convoy movements.

8. The method for rail transport according to the claim 7, comprising:

providing a waiting order for first and second waiting wagons at a transit station of the stations of the rail network infrastructure that depends on desired destination stations for the first and second waiting wagons, respectively, by placing the second waiting wagon ahead of or behind the first waiting wagon depending on whether the destination station of the second waiting wagon is before or after the destination station of the first waiting wagon;

in the transit station, coupling the waiting wagons to the convoy and uncoupling any wagons of the convoy having the transit station as their point of destination;

in terminal stations, coupling empty wagons to the convoy in a variable number, to satisfy existing demands for empty wagons from one or more intermediate stations, increased by a number held to be congruous to satisfy demands coming after the departure of the convoy.

9. The method for rail transport according to claim 7, comprising shunting a waiting wagon to the convoy while the convoy is moving through one of the stations, by separating the convoy at a point where the waiting wagon is desired to be inserted, a head of the convoy continuing ahead slowly, passing a switching point where the waiting wagon is parked, the waiting wagon being configured to move onto a track on which the convoy is moving, and to proceed to couple itself to the head of the convoy.

* * * * *